US010359034B2

(12) United States Patent
Oikawa

(10) Patent No.: US 10,359,034 B2
(45) Date of Patent: Jul. 23, 2019

(54) CRYOPUMP

(71) Applicant: SUMITOMO HEAVY INDUSTRIES, LTD., Tokyo (JP)

(72) Inventor: Ken Oikawa, Tokyo (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 42 days.

(21) Appl. No.: 15/473,518

(22) Filed: Mar. 29, 2017

(65) Prior Publication Data

US 2017/0284384 A1 Oct. 5, 2017

(30) Foreign Application Priority Data

Mar. 29, 2016 (JP) ..... 2016-066196

(51) Int. Cl.
*F04B 37/08* (2006.01)

(52) U.S. Cl.
CPC ..... *F04B 37/08* (2013.01); *F04B 37/085* (2013.01)

(58) Field of Classification Search
CPC ..... F04B 37/08; F04B 37/085; F25B 9/10; F25D 19/006
See application file for complete search history.

(56) References Cited

U.S. PATENT DOCUMENTS 4,336,690 A * 6/1982 Welch ..... F04B 37/08 417/901
2007/0283704 A1* 12/2007 Tanaka ..... F04B 37/08 62/55.5
2014/0260338 A1* 9/2014 Kimura ..... F04B 37/085 62/55.5

FOREIGN PATENT DOCUMENTS

JP 2551204 B2 2/1992
JP 4430042 B2 12/2007
JP 2011-117464 A 6/2011
JP 5254993 B2 8/2013
WO WO-2008/088794 A2 7/2008

* cited by examiner

*Primary Examiner* — Keith M Raymond
*Assistant Examiner* — Webeshet Mengesha
(74) *Attorney, Agent, or Firm* — Michael Best & Friedrich LLP

(57) ABSTRACT

A cryopump includes a cryocooler which includes a first cooling stage, a second cooling stage having a tip stage surface, and a cryocooler structure portion which extends in an axial direction from the first cooling stage to the second cooling stage, a radiation shield which is thermally coupled to the first cooling stage and includes a shield front end which defines a shield main opening and a shield bottom portion having a cryocooler insertion hole which receives the cryocooler structure portion such that the tip stage surface faces the shield main opening, a cap member which surrounds the tip stage surface in a non-contact manner and is thermally coupled to the first cooling stage, and a second stage cryopanel which is disposed between the cap member and the first cooling stage in the axial direction and is thermally coupled to the second cooling stage.

15 Claims, 7 Drawing Sheets

CRYOPUMP

RELATED APPLICATIONS

Priority is claimed to Japanese Patent Application No. 2016-066196, filed Mar. 29, 2016, the entire content which is incorporated herein by reference.

BACKGROUND

Technical Field

Certain embodiments of the present invention relate to a cryopump.

Description of Related Art

A cryopump is a vacuum pump which captures gas by condensing or adsorbing the gas on a cryopanel cooled to a cryogenic temperature. A vacuum chamber to which the cryopump is attached is evacuated by the cryopump.

SUMMARY

According to an embodiment of the present invention, there is provided a cryopump including: a cryocooler which includes a high-temperature cooling stage, a low-temperature cooling stage having an axial tip stage surface, and a cryocooler structure portion which extends in an axial direction from the high-temperature cooling stage to the low-temperature cooling stage; a radiation shield which is thermally coupled to the high-temperature cooling stage and includes a shield front end which defines a shield main opening and a shield bottom portion having a cryocooler insertion hole which receives the cryocooler structure portion such that the axial tip stage surface faces the shield main opening; a non-contact cap member which surrounds the axial tip stage surface in a non-contact manner and is thermally coupled to the high-temperature cooling stage; and a low-temperature cryopanel portion which is disposed between the cap member and the high-temperature cooling stage in the axial direction and is thermally coupled to the low-temperature cooling stage.

DETAILED DESCRIPTION

Figure 1:
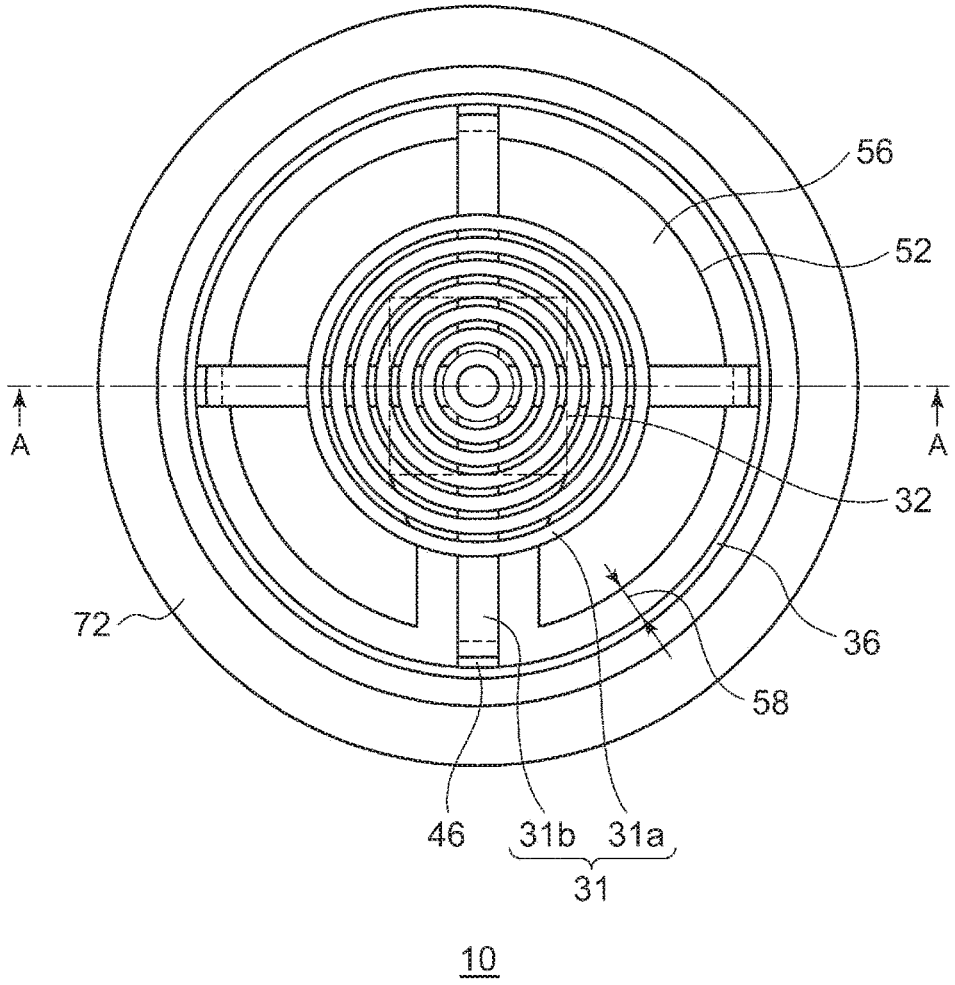
FIG. 1 is a top view schematically showing a cryopump according to one embodiment.

Typically, the cryopump includes a first cryopanel which is cooled to a predetermined temperature and a second cryopanel which is cooled to a lower temperature than the predetermined temperature. A radiation shield is included in the first cryopanel. As the cryopump is used, a condensed layer of gas grows on the second cryopanel. The condensed layer can come into contact with either the radiation shield or a portion of the first cryopanel. Accordingly, the gas is vaporized again at the contact portion and a pressure inside the cryopump increases. After that, the cryopump cannot fully fulfill an original role such as evacuating the vacuum chamber. Therefore, a gas storage amount when the condensed layer comes into contact with the first cryopanel gives a storage limit of the cryopump.

It is desirable to improve a storage limit of a cryopump.

In addition, an embodiment of the present invention also includes replacements of components or expressions of the present invention between a method, a device, a system, or the like.

According to an embodiment of the present invention, it is possible to improve a storage limit of a cryopump.

Hereinafter, embodiments of the present invention will be described in detail with reference to the drawings. In descriptions and the drawings, the same reference numerals are assigned to the same or equivalent components, members, and processing, and overlapping descriptions thereof are omitted. Scales or shapes of respective portions shown in the drawings are set for the sake of convenience in order to facilitate the explanations, and are not to be interpreted restrictively unless otherwise mentioned particularly. The embodiments are examples and do not limit the scope of the present invention. All the features described in the embodiments and combinations thereof are not necessarily essential to the invention.

Figure 2:
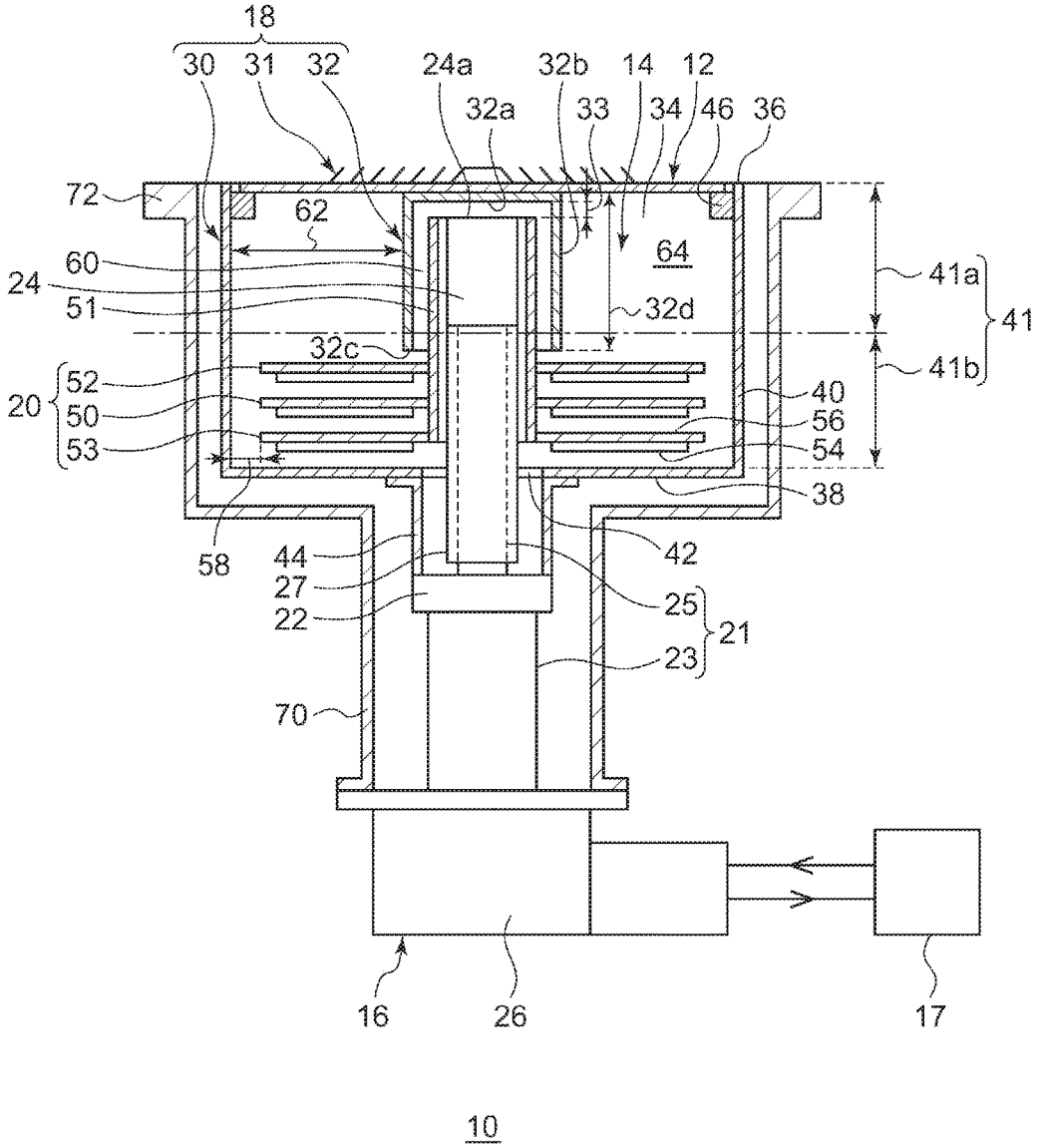
FIG. 2 schematically shows a cross section taken along line A-A of the cryopump shown in FIG. 1.

FIG. 1 is a top view schematically showing a cryopump 10 according to one embodiment. FIG. 2 schematically shows a cross section taken along line A-A of the cryopump 10 shown in FIG. 1.

For example, the cryopump 10 is attached to a vacuum chamber of an ion implantation apparatus, a sputtering apparatus, a vapor deposition apparatus, or other vacuum processing apparatuses and is used so as to increase a degree of vacuum inside the vacuum chamber to a level required for a desired vacuum process. The cryopump 10 has an intake port 12 for receiving gas to be evacuated from the vacuum chamber. Gas enters an internal space 14 of the cryopump 10 through the intake port 12.

In the following description, terms such as an "axial direction" and a "radial direction" may be used to clearly indicate positional relationships of components of the cryopump 10. The axial direction represents a direction passing through the intake port 12 (up-down direction in FIG. 2), and the radial direction represents a direction along the intake port 12 (right-left direction in FIG. 2). For convenience, a side which is relatively close to the intake port 12 in the axial direction may be referred to as an "upper side", and a side which is relatively far from the intake port 12 in the axial direction may be referred to as a "lower side". That is, a side which is relatively far from a bottom portion of the cryopump 10 may be referred to as the "upper side", and a side which is relatively close to the bottom portion of the cryopump 10 may be referred to as the "lower side". A side close to the center of the intake port 12 in the radial direction may be referred to as an "inside", and a side close to a circumference of the intake port 12 may be referred to as an "outside". In addition, the expressions are not related to a disposition when the cryopump 10 is attached to the vacuum chamber. For example, the cryopump 10 may be attached to the vacuum chamber in a state where the intake port 12 faces downward in a vertical direction.

In addition, a direction surrounding the axial direction may be referred to as a "circumferential direction". The circumferential direction is a second direction along the intake port 12 and is a tangential direction orthogonal to the radial direction.

The cryopump 10 includes a cryocooler 16, a first stage cryopanel 18, a second stage cryopanel 20, and a cryopump housing 70. The first stage cryopanel 18 may be referred to as a high-temperature cryopanel portion or 100K portion. The second stage cryopanel 20 may be referred to as a low-temperature cryopanel portion or 10K portion.

For example, the cryocooler 16 is a cryocooler such as a Gifford McMahon type cryocooler (so-called GM cryocooler). The cryocooler 16 is a two-stage cryocooler. Accordingly, the cryocooler 16 includes a first cooling stage 22 and a second cooling stage 24. The cryocooler 16 is configured so as to cool the first cooling stage 22 to a first cooling temperature and cool the second cooling stage 24 to a second cooling temperature. The second cooling temperature is lower than the first cooling temperature. For example, the first cooling stage 22 is cooled to approximately 65K to 120K, preferably, 80K to 100K, and the second cooling stage 24 is cooled to approximately 10K to 20K. Accordingly, the first cooling stage 22 and the second cooling stage 24 may be respectively referred to as a high-temperature cooling stage and a low-temperature cooling stage.

In addition, the cryocooler 16 includes a cryocooler structure portion 21 which structurally supports the second cooling stage 24 to the first cooling stage 22 and structurally supports the first cooling stage 22 to a room temperature portion 26 of the cryocooler 16. Accordingly, the cryocooler structure portion 21 includes a first cylinder 23 and a second cylinder 25 which coaxially extend in the axial direction. The first cylinder 23 connects the room temperature portion 26 of the cryocooler 16 to the first cooling stage 22. The second cylinder 25 connects the first cooling stage 22 to the second cooling stage 24. The room temperature portion 26, the first cylinder 23, the first cooling stage 22, the second cylinder 25, and the second cooling stage 24 are arranged in a straight line in this order.

A first displacer (not shown) and a second displacer (not shown) are respectively disposed so as to reciprocate inside the first cylinder 23 and the second cylinder 25. A first regenerator (not shown) and a second regenerator (not shown) are respectively incorporated into the first displacer and the second displacer. In addition, the room temperature portion 26 includes a drive mechanism (not shown) for reciprocating the first displacer and the second displacer. The drive mechanism includes a flow path switching mechanism which switches a flow path of a working gas (for example helium) so as to periodically repeat supply and discharge of the working gas to the inside of the cryocooler 16.

The cryocooler 16 is connected to a compressor 17 of the working gas. The cryocooler 16 expands the working gas compressed by the compressor 17 inside the cryocooler 16 to cool the first cooling stage 22 and the second cooling stage 24. The expanded working gas is returned to the compressor 17 and is compressed again. The cryocooler 16 generates coldness by repeating a thermal cycle including the supply and discharge of the working gas and reciprocations of the first displacer and the second displacer synchronized with the supply and discharge of the working gas.

The shown cryopump 10 is a so-called vertical type cryopump. In general, the vertical type cryopump is a cryopump in which the cryocooler 16 is disposed along a center axis of the cryopump 10.

The cryopump housing 70 is a casing of the cryopump 10 which accommodates the first stage cryopanel 18, the second stage cryopanel 20, and the cryocooler 16, and is a vacuum container which is configured to maintain vacuum and air-tightness of the internal space 14. The cryopump housing 70 includes the first stage cryopanel 18 and the cryocooler structure portion 21 in a non-contact manner. The cryopump housing 70 is attached to the room temperature portion 26 of the cryocooler 16.

The cryopump housing 70 includes an intake port flange 72 which extends from the front end of the cryopump housing 70 toward the outside in the radial direction. The intake port flange 72 is provided over the entire circumference of the cryopump housing 70. The intake port flange 72 defines the intake port 12. The cryopump 10 is attached to a vacuum chamber, which is an object to be vacuum-evacuated, using the intake port flange 72.

As shown in the drawings, an inlet cryopanel 31 may be positioned above the intake port flange 72 in the axial direction. However, the inlet cryopanel 31 is positioned so as not to interfere with the vacuum chamber (or a gate valve (not shown) between the vacuum chamber and the cryopump 10) to which the cryopump 10 is attached.

The first stage cryopanel 18 surrounds the second stage cryopanel 20. The first stage cryopanel 18 provides a cryogenic temperature surface for protecting the second stage cryopanel 20 from radiant heat from the outside of the cryopump 10 or the cryopump housing 70. The first stage cryopanel 18 is thermally coupled to the first cooling stage 22. Accordingly, the first stage cryopanel 18 is cooled to the first cooling temperature. The first stage cryopanel 18 has a gap between the first stage cryopanel 18 and the second stage cryopanel 20 and the first stage cryopanel 18 does not come into contact with the second stage cryopanel 20. The first stage cryopanel 18 also does not come into contact with the cryopump housing 70.

The first stage cryopanel 18 includes a radiation shield 30, the inlet cryopanel 31, and a non-contact cap member (hereinafter, may be also referred to as a cap member) 32.

The radiation shield 30 is provided so as to protect the second stage cryopanel 20 from the radiant heat of the cryopump housing 70. The radiation shield 30 is positioned between the cryopump housing 70 and the second stage cryopanel 20 and surrounds the second stage cryopanel 20. The radiation shield 30 has a shield main opening 34 for receiving gas from the outside of the cryopump 10 into the internal space 14. The shield main opening 34 is positioned at the intake port 12.

The radiation shield 30 includes a shield front end 36 which defines the shield main opening 34, a shield bottom portion 38 which is positioned on a side opposite to the shield main opening 34, and a shield side portion 40 which connects the shield front end 36 to the shield bottom portion 38. The shield side portion 40 extends in the circumferential direction so as to surround the second cooling stage 24.

The shield bottom portion 38 has a cryocooler insertion opening 42, which receives the cryocooler structure portion 21, at the center portion of the shield bottom portion 38. The second cooling stage 24 and the second cylinder 25 are inserted into the radiation shield 30 through the cryocooler insertion opening 42 from the outside of the radiation shield 30. The cryocooler insertion opening 42 is an attachment hole which is formed in the shield bottom portion 38 and, for example, has a circular shape. The first cooling stage 22 is disposed outside the radiation shield 30.

The radiation shield 30 is thermally coupled to the first cooling stage 22 via a heat transfer sleeve 44. One end of the heat transfer sleeve 44 is attached to the shield bottom portion 38 so as to surround the cryocooler insertion opening 42 and the other end of the heat transfer sleeve 44 is attached to the first cooling stage 22. In addition, the radiation shield 30 may be directly attached to the first cooling stage 22.

In the shown embodiment, the radiation shield 30 is formed in an integral tubular shape. Instead of this, the radiation shield 30 may be configured to be formed in a tubular shape as a whole by a plurality of parts. The plurality of parts may be disposed with gaps therebetween. For example, the radiation shield 30 may be divided into two portions in the axial direction.

A second cylinder cover 27 which surrounds the second cylinder 25 is provided in the cryocooler 16. The second cylinder cover 27 extends to penetrate the radiation shield 30 from the second cooling stage 24 toward the first cooling stage 22. The second cylinder cover 27 passes through the cryocooler insertion opening 42 without coming into contact with the radiation shield 30. In order to minimize exposure of the second cylinder 25, the end portion of the second cylinder cover 27 approaches the first cooling stage 22 but does not come into contact with the first cooling stage 22. Since the second cylinder cover 27 is thermally coupled to the second cooling stage 24, the second cylinder cover 27 is cooled to the second cooling temperature.

In addition, the second cooling stage 24 includes an axial tip stage surface (hereinafter, may be also referred to as a tip stage surface) 24*a*. The cryocooler insertion opening 42 receives the cryocooler structure portion 21 (second cylinder 25) such that the tip stage surface 24*a* faces the shield main opening 34. Accordingly, the tip stage surface 24*a* is a portion which is positioned at the uppermost position of the cryocooler 16 in the axial direction.

The inlet cryopanel 31 is provided in the shield main opening 34 so as to protect the second stage cryopanel 20 from radiant heat from an external heat source (for example, a heat source in the vacuum chamber to which the cryopump 10 is attached) of the cryopump 10. The inlet cryopanel 31 also restricts entering of gas molecules into the cryopump 10 as well as entering of the radiant heat. The inlet cryopanel 31 occupies a portion (for example, the most part) of an opening area of a shield main opening 34 so as to restrict a gas flow into the radiation shield 30 to a desired amount. In addition, gas (for example, moisture) condensed at the cooling temperature of the inlet cryopanel 31 is captured on the surface of the inlet cryopanel 31.

The inlet cryopanel 31 is attached to the shield front end 36 via a joint block 46. In this way, the inlet cryopanel 31 is fixed to the radiation shield 30 and is thermally connected to the radiation shield 30. The inlet cryopanel 31 is disposed at the center portion of the shield main opening 34.

The inlet cryopanel 31 is formed of a plurality of louver boards 31*a*, the respective louver boards 31*a* are formed in side surface shapes of truncated cones having diameters different from each other and are concentrically disposed. Although there is a gap between the respective louver boards 31*a* in FIG. 1, adjacent louver boards 31*a* may overlap each other and the respective louver boards 31*a* may be densely arranged so as not to have gaps when viewed from above. Each of the louver boards 31*a* is attached to an upper surface of a cruciform support member 31*b* and the support member 31*b* is attached to the joint block 46.

Each of the joint blocks 46 is a protrusion portion which protrudes from the shield front end 36 to the inside in the radial direction, and the joint blocks 46 are formed at equal intervals (for example, 90° intervals) in the circumferential direction. The inlet cryopanel 31 is fixed to the joint blocks 46 by an appropriate method. For example, each of the joint blocks 46 and the support members 31*b* has a bolt hole (not shown) and the support members 31*b* are screwed to the joint blocks 46.

The inlet cryopanel 31 has a planar structure which is disposed on the intake port 12. Accordingly, the inlet cryopanel 31 may be formed in other shapes such as a lattice shape instead of a concentric circular shape. Moreover, the inlet cryopanel 31 may have a flat plate (for example, a circular plate).

The cap member 32 surrounds the tip stage surface 24*a* in a non-contact manner. The cap member 32 is hung from the center portion of the inlet cryopanel 31 and extends downward in the axial direction. The cap member 32 is a box-shaped non-contact cover (or lid) which covers the tip stage surface 24*a*. For example, the cap member 32 has a rectangular parallelepiped shape with an opened lower end, but may have other shapes such as a cylindrical shape.

The cap member 32 is attached to the inlet cryopanel 31. Accordingly, the cap member 32 is thermally coupled to the first cooling stage 22 via the inlet cryopanel 31 and the radiation shield 30. The cap member 32 is not in physical contact with the first cooling stage 22. In addition, the cap member 32 is not in physical contact with the radiation shield 30. Compared to a case where the cap member 32 is physically attached directly to the first cooling stage 22 (or the radiation shield 30) to be thermally coupled, the shape of the cap member 32 can be made simpler.

The cap member 32 includes a cap upper end 32*a*, a cap side portion 32*b*, and a cap lower end 32*c*. The cap upper end 32*a* is attached to the lower surface of the support member 31*b* and is positioned above the tip stage surface 24*a* in the axial direction. The cap upper end 32*a* is a plate-shaped portion which faces the tip stage surface 24*a*. The cap side portion 32*b* is a tubular portion (for example, a rectangular tubular shape) which extends downward in the axial direction from the outer circumferential portion of the cap upper end 32*a* and terminates at the cap lower end 32*c*. The cap lower end 32*c* is positioned below the tip stage surface 24*a* in the axial direction. Since the cap lower end 32*c* is open, the cap member 32 does not have a bottom plate on the cap lower end 32*c*.

The cap upper end 32*a* is disposed to be in proximity to the tip stage surface 24*a* in the axial direction.

In the present specification, a member and another member "being disposed to be in proximity to each other" indicates that the members are disposed in a non-contact manner so as to maintain a temperature difference of two members. For example, there is a gap between two members such as at least 3 mm, at least 5 mm, or at least 7 mm. For example, the gap may be within 20 mm, 15 mm, or 10 mm.

For example, an axial distance 33 from the cap upper end 32*a* to the tip stage surface 24*a* is less than 1/10 of a shield depth 41 from the shield front end 36 to the shield bottom portion 38. The axial distance 33 may be less than 1/20 of the shield depth 41. In this way, since the second cooling stage 24 is close to the cap member 32, it is possible to decrease the entire length in the axial direction of the cryopump 10.

A cap axial length 32*d* from the cap upper end 32*a* to the cap lower end 32*c* is longer than the axial distance 33 from the cap upper end 32*a* to the tip stage surface 24*a*. The cap axial length 32*d* may be longer than two times the axial distance 33, 5 times the axial distance 33, or 10 times the axial distance 33. In this way, the cap member 32 can cover the entire second cooling stage 24. Accordingly, the cap member 32 can prevent a condensate from being attached to the second cooling stage 24.

However, the cap member 32 can cover only a portion of the second cylinder 25. The cap lower end 32*c* surrounds a portion of the second cylinder 25 adjacent to the second cooling stage 24. The cap member 32 covers only a low-temperature portion of a second stage of the cryocooler 16. Here, the second stage of the cryocooler 16 includes the second cooling stage 24 and the second cylinder 25.

In addition, the cap axial length 32*d* is shorter than an axial distance from the inlet cryopanel 31 to the top cryopanel 52. In this way, it is possible to accommodate the cap member 32 in a space below the inlet cryopanel 31 and a space above the top cryopanel 52. The cap upper end 32*a* is attached to the lower surface of the inlet cryopanel 31 and the cap member 32 does not protrude upward from the inlet cryopanel 31.

The second stage cryopanel 20 includes a plurality of cryopanels 50. In addition, a low-temperature cryopanel attachment member (hereinafter, may be also referred to as a cryopanel attachment member) 51 is provided, which extends downward in the axial direction from the second cooling stage 24. The second stage cryopanel 20 is attached to the second cooling stage 24 via the cryopanel attachment member 51. In this way, the second stage cryopanel 20 is thermally connected to the second cooling stage 24. Accordingly, the second stage cryopanel 20 is cooled to the second cooling temperature.

The plurality of cryopanel 50 are arranged on the cryopanel attachment member 51 in the direction (that is, in the axial direction) from the shield main opening 34 toward the shield bottom portion 38. Each of the plurality of cryopanels 50 is a flat plate (for example, a circular plate) extending perpendicularly in the axial direction and the cryopanels 50 are attached to the cryopanel attachment member 51 so as to be parallel to each other. For convenience of description, the cryopanel which is closest to the intake port 12 among the plurality of cryopanels 50 is referred to as a top cryopanel 52, and the cryopanel which is closest to the shield bottom portion 38 among the plurality of cryopanels 50 is referred to as a bottom cryopanel 53.

The plurality of cryopanels 50 may have the same shape as each other as shown, or may have shapes different (for example, diameters different) from each other. In addition, gaps between the plurality of cryopanels 50 may be constant as shown, or may be different from each other.

In the second stage cryopanel 20, an adsorption region 54 is formed on at least a portion of the surface. The adsorption region 54 is provided so as to capture noncondensable gas (for example, hydrogen) by adsorption. For example, the adsorption region 54 is formed on the lower surface of each cryopanel 50. For example, the adsorption region 54 is formed by bonding an adsorption material (for example, activated carbon) to the surface of the cryopanel.

A condensation region 56 for capturing condensable gas by condensation is formed on at least a portion of the surface of the second stage cryopanel 20. For example, the condensation region 56 is formed on the upper surface of each cryopanel 50. For example, the condensation region 56 is an area in which the adsorption material does not exist on the surface of the cryopanel and a surface of a cryopanel substrate, for example, a metal surface is exposed.

The top cryopanel 52 is relatively large, and accordingly, a radial gap 58 which is relatively narrow is formed between the top cryopanel 52 and the radiation shield 30. For example, a diameter of the top cryopanel 52 is 70% or more of a diameter of the shield main opening 34. In addition, the diameter of the top cryopanel 52 is 98% or less of the diameter of the shield main opening 34. In this way, it is possible to cause the top cryopanel 52 to be in reliable non-contact with the radiation shield 30.

The top cryopanel 52 is disposed to be in proximity to the cap lower end 32*c* in the axial direction. The top cryopanel 52 is disposed to be in non-contact with the cap lower end 32*c* and a temperature difference between the top cryopanel 52 and the cap member 32 is maintained.

The axial distance from the shield front end 36 to the top cryopanel 52 may be two times or more the axial distance from the shield front end 36 to the tip stage surface 24*a* (or the axial distance 33 from the cap upper end 32*a* to the tip stage surface 24*a*). In addition, the axial distance from the shield front end 36 to the top cryopanel 52 may be 5 times or more or 10 times or more the axial distance from the shield front end 36 to the tip stage surface 24*a*. In this way, an annular empty space 64 which is relatively wide in the axial direction is formed between the inlet cryopanel 31 and the top cryopanel 52.

The second stage cryopanel 20 is disposed between the cap member 32 and the shield bottom portion 38 in the axial direction. Since the first cooling stage 22 is positioned to be lower than the shield bottom portion 38 in the axial direction, the second stage cryopanel 20 is disposed between the cap member 32 and the first cooling stage 22 in the axial direction. The tip stage surface 24*a* is positioned at an upper half 41*a* of the shield depth 41 from the shield front end 36 to the shield bottom portion 38. Any cryopanel 50 is not provided on the tip stage surface 24*a*. The top cryopanel 52 is positioned at a lower half 41*b* of the shield depth 41 (that is, all cryopanels 50 are positioned at the lower half 41*b* of the shield depth 41). Alternatively, the top cryopanel 52 (that is, the cryopanel 50) may be at the lowermost region among regions obtained by equally dividing the shield depth 41 into three equal portions. This also helps to widen the empty space 64.

A radial distance 62 between the cap member 32 and the shield side portion 40 is larger than the radial gap 58 between the cryopanel 50 and the shield side portion 40. Accordingly, the empty space 64 is widened in the radial direction. The empty space 64 is a space for accommodating condensate which is condensed and deposited on the top cryopanel 52. Any cryopanel or other members are not provided between the cap side portion 32*b* and the shield side portion 40. Particularly, other members are not attached to the outer circumferential surface of the cap side portion 32*b*.

The cryopanel attachment member 51 extends from the second cooling stage 24 to the second stage cryopanel 20 in a gap 60 between the cap member 32 and the second cooling stage 24. The upper end of the cryopanel attachment member 51 is attached to the second cooling stage 24 and the lower end thereof is attached to the bottom cryopanel 53. In this way, the cryopanel attachment member 51 extends from the tip stage surface 24*a* to the bottom cryopanel 53. The cryopanel attachment member 51 is disposed to be in proximity to the cap side portion 32*b* in the radial direction.

A radial distance (a width of the gap 60) between the cap member 32 (more specifically, the cap side portion 32*b*) and the second cylinder 25 is smaller than the diameter of the second cylinder 25. The radial distance between the cap member 32 and the second cylinder 25 may be smaller than the radius of the second cylinder 25 or ¼ of the diameter of the second cylinder 25. Accordingly, since the cap member 32 is disposed to be close to the second cylinder 25, it is possible to widen the empty space 64. It is possible to prevent the diameter of the intake port 12 (the diameter of the cryopump housing 70 or the radiation shield 30) from being unnecessarily increased in order to secure a desired volume in the empty space 64. In addition, it is possible to prevent gas from flowing into the gap 60 by narrowing the gap 60.

Moreover, the diameter of the cap member 32 may be approximately the same as the diameter of the first cylinder 23 or may be smaller than the diameter of the first cylinder 23.

Figure 3:
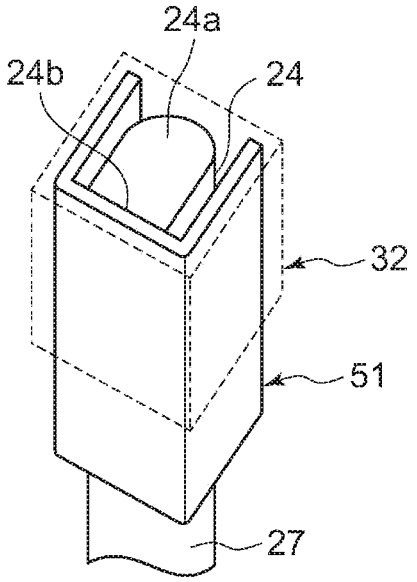
FIG. 3 is a perspective view schematically showing a cryopanel attachment member according to the one embodiment.

FIG. 3 is a perspective view schematically showing the cryopanel attachment member 51 according to the one embodiment. In FIG. 3, for easy understanding, the cap member 32 is shown by broken lines and the cryopanel 50 is not shown.

The cryopanel attachment member 51 is attached to a side surface 24*b* of the second cooling stage 24 such that the tip stage surface 24*a* directly faces the cap member 32. Since the cryopanel attachment member 51 does not cover the tip stage surface 24*a*, it is possible to cause the tip stage surface 24*a* to be close to the cap member 32. This also helps to shorten the axial length of the cryopump 10.

Figure 4:
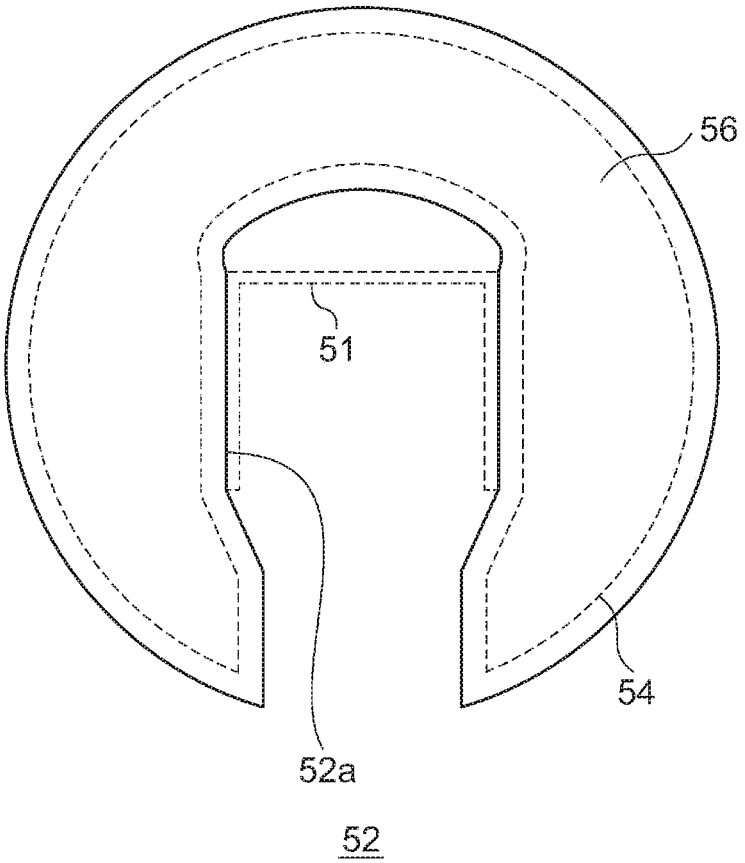
FIG. 4 is a top view schematically showing a top cryopanel according to the one embodiment.

FIG. 4 is a top view schematically showing the top cryopanel 52 according to the one embodiment. As described above, the entire area of the upper surface of the top cryopanel 52 is the condensation region 56 and the adsorption material is not provided on the upper surface. As shown by broken lines, the adsorption region 54 is provided on the lower surface of the top cryopanel 52.

A notch portion 52*a* is formed from a portion of the outer circumference of the top cryopanel 52 to the center portion in the top cryopanel 52. The notch portion 52*a* is provided so as to attach the top cryopanel 52 to the cryopanel attachment member 51. Since the notch portion 52*a* is provided, the top cryopanel 52 can be shared with a horizontal type cryopump (that is, can be easily attached to the horizontal type cryopump).

In addition, the top cryopanel 52 may not have the notch portion 52*a* in the circumferential portion. In this case, the top cryopanel 52 may be formed in a disk shape having a center hole or a doughnut shape. Alternatively, the top cryopanel 52 may be formed in a disk shape without the notch portion 52*a*.

An operation of the cryopump 10 having the above-described configuration will be described as follows. When the cryopump 10 is operated, first, the inside of the vacuum chamber is roughly pressurized to approximately 1 Pa by another appropriate roughing vacuum pump before the operation of the cryopump 10. Thereafter, the cryopump 10 is operated. The first cooling stage 22 and the second cooling stage 24 are respectively cooled to the first cooling temperature and the second cooling temperature by the driving of the cryocooler 16. Accordingly, the first stage cryopanel 18 and the second stage cryopanel 20, which are thermally coupled to the first cooling stage 22 and the second cooling stage 24, are respectively cooled to the first cooling temperature and the second cooling temperature.

The inlet cryopanel 31 cools gas flying from the vacuum chamber toward the cryopump 10. Gas of which a vapor pressure is sufficiently low (for example, $10^{-8}$ Pa or less) at the first cooling temperature is condensed on the surface of the inlet cryopanel 31. This gas may be referred to as a first type gas. For example, the first type gas is steam. In this way, the inlet cryopanel 31 can evacuate the first type gas. A portion of the gas of which the vapor pressure is not sufficiently low at the first cooling temperature enters the internal space 14 from the intake port 12. Alternatively, other portions of the gas are reflected by the inlet cryopanel 31 and do not enter the internal space 14.

The gas which enters the internal space 14 is cooled by the second stage cryopanel 20. Gas of which the vapor pressure is sufficiently low (for example, $10^{-8}$ Pa or less) at the second cooling temperature is condensed on the surface of the second stage cryopanel 20. This gas may be referred to a second type gas. For example, the second type gas is argon. In this way, the second stage cryopanel 20 can evacuate the second type gas.

Gas of which the vapor pressure is not sufficiently low at the second cooling temperature is adsorbed on the adsorption material of the second stage cryopanel 20. This gas may be referred to a third type gas. For example, the third type gas is hydrogen. In this way, the second stage cryopanel 20 can evacuate the third type gas. Therefore, the cryopump 10 evacuate various gases by condensation or adsorption, and a degree of vacuum of the vacuum chamber can reach a desired level.

Figure 5:
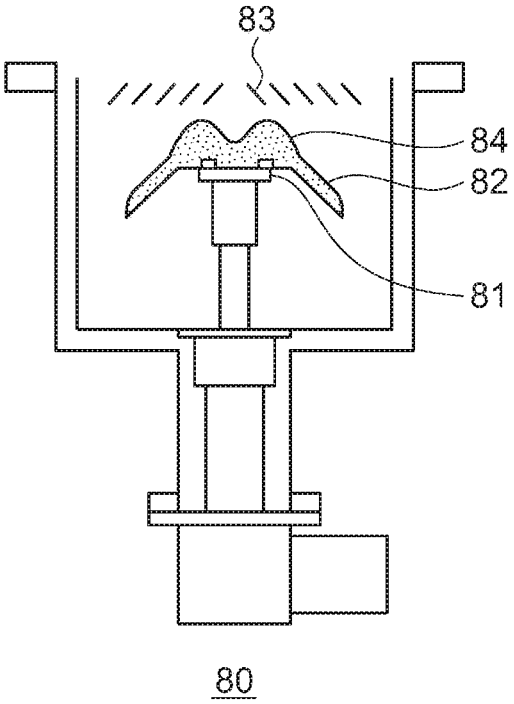
FIG. 5 schematically shows a state of a cryopump during an operation.

FIG. 5 schematically shows the state of a cryopump 80 during the operation. In the cryopump 80, a second stage cryopanel 82 is attached to the upper surface of a second cooling stage 81. Accordingly, a space between the second stage cryopanel 82 and a first stage cryopanel 83 is relatively narrow. As shown in the drawing, the second type gas is condensed on the second stage cryopanel 82 according to the use of the cryopump 80, and a frost-like condensate 84 is grown. If the condensate 84 comes into contact with the first stage cryopanel 83, gas is vaporized from the condensate 84. In this way, the cryopump 80 reaches a storage limit.

Figure 6:
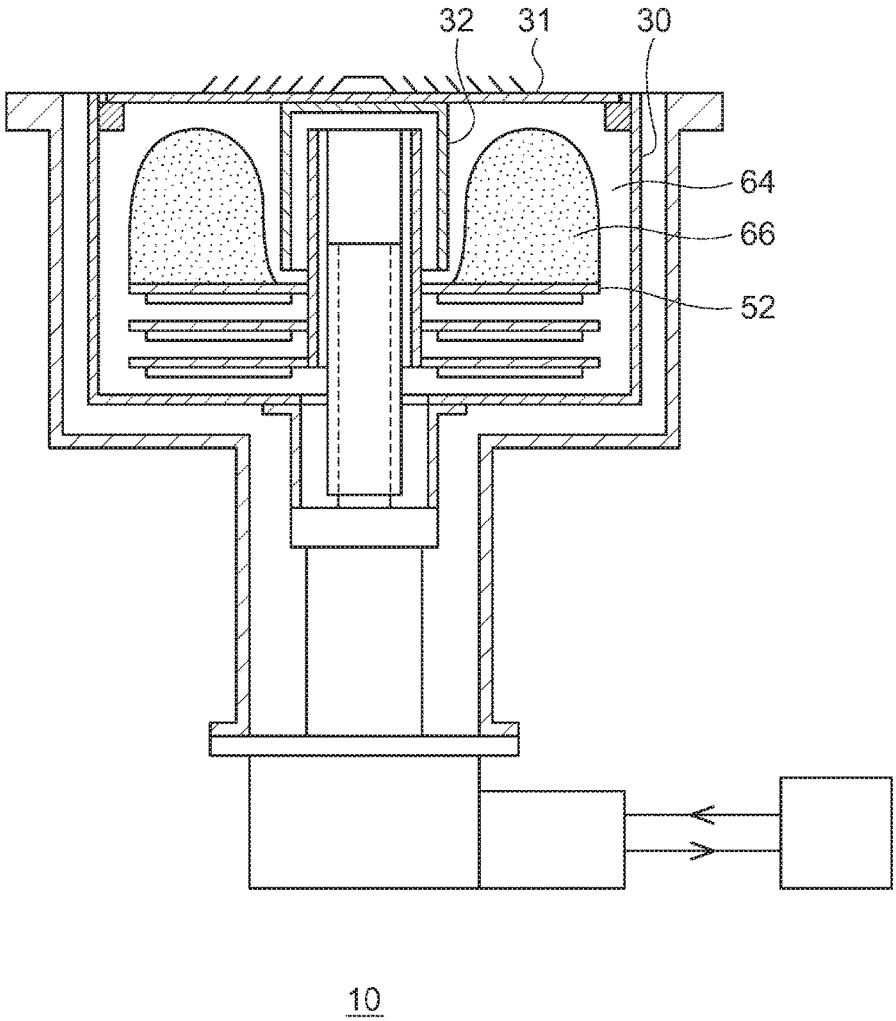
FIG. 6 schematically shows a state of the cryopump according to the one embodiment during an operation.

FIG. 6 is schematically shows a state of the cryopump 10 according to the one embodiment during the operation. For simplicity, in FIG. 6, a condensate 66 deposited on the top cryopanel 52 is shown, and a condensate deposited on other cryopanels 50 is not shown.

As described above, in the cryopump 10, a wide empty space 64 is secured so as to accommodate the condensate 66. Since the tip stage surface 24*a* is covered with the cap member 32, gas is little or never condensed on the tip stage surface 24*a*. Not only the tip stage surface 24*a*, the entire second cooling stage 24 and the cryopanel attachment member 51 in the vicinity of the second cooling stage 24 are covered with the cap member 32. In this way, it is possible to provide the cryopump 10 in which the storage limit of the second type gas is improved. Particularly, it is possible to improve the storage amount of the second type gas in a vertical type cryopump.

In addition, the second cooling stage 24 is disposed to be in proximity to the inlet cryopanel 31. Accordingly, it is possible to shorten the entire length in the axial direction of the cryopump 10. It is possible to provide a vertical type cryopump in which the axial length is shortened.

Figure 7:
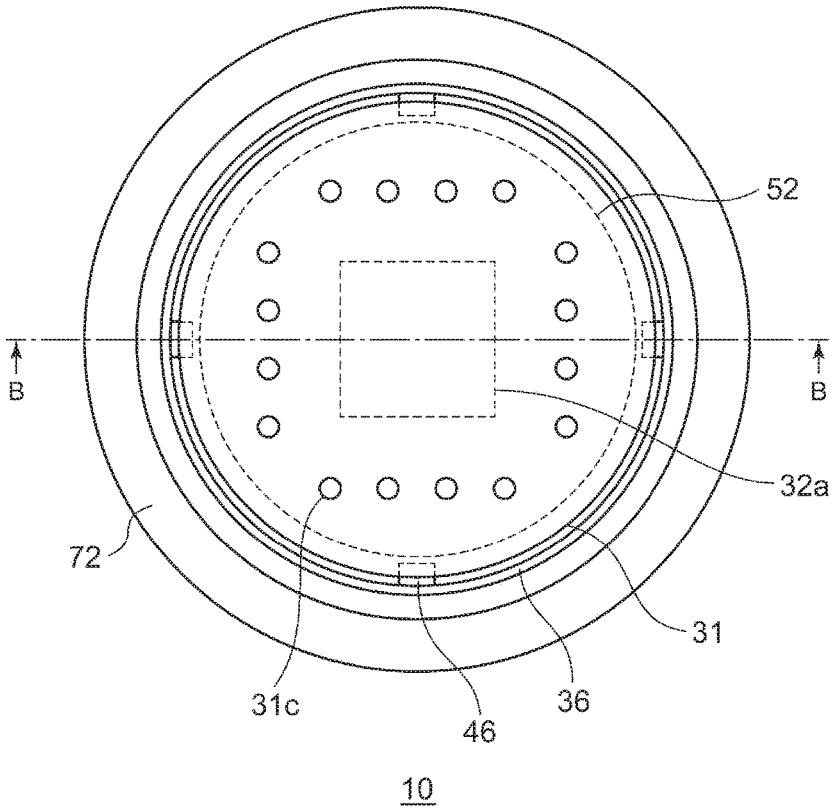
FIG. 7 is a top view schematically showing a cryopump according to another embodiment.
Figure 8:
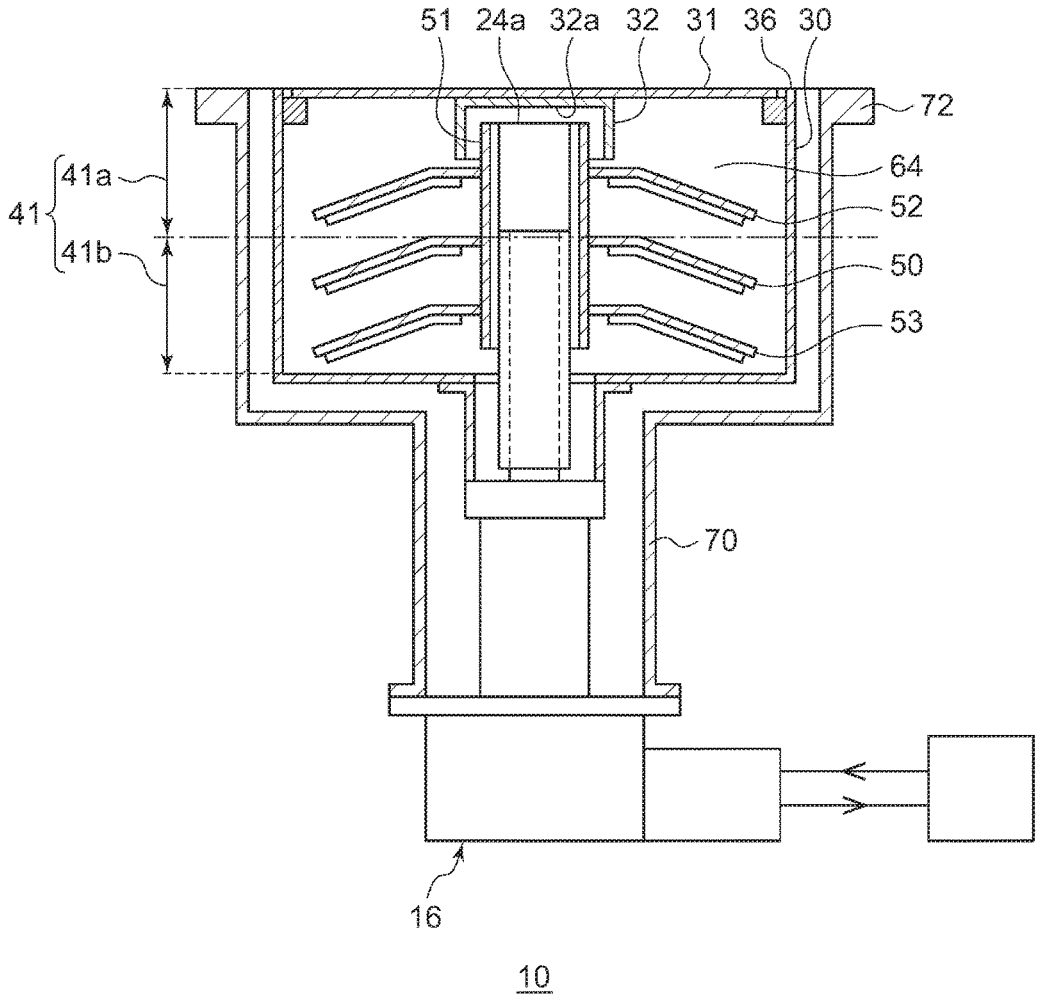
FIG. 8 schematically shows a cross section taken along line B-B of the cryopump shown in FIG. 7.

FIG. 7 is a top view schematically showing a cryopump 10 according to another embodiment. FIG. 8 schematically shows a cross section taken along line B-B of the cryopump 10 shown in FIG. 7. With respect to locations of another embodiment similar to those of the one embodiment, descriptions thereof are appropriately omitted in order to avoid redundancy.

Unlike the one embodiment, the cryopanel 50 has a conical shape. The top cryopanel 52 is positioned at the upper half 41*a* of the shield depth 41 and the bottom cryopanel 53 is positioned at the lower half 41*b* of the shield depth 41.

However, similarly to the one embodiment, the top cryopanel 52 is disposed to be in proximity to the cap member 32 in the axial direction. The axial distance from the shield front end 36 to the top cryopanel 52 is two times or more the axial distance from the shield front end 36 to the tip stage surface 24*a*.

Similarly to the one embodiment, the cap member 32 is not in physical contact with the radiation shield 30 and the first cooling stage of the cryocooler 16. The cap member 32 is attached to the radiation shield 30 via the inlet cryopanel 31 and is thermally coupled to the first cooling stage of the cryocooler 16. In addition, the radial distance between the cap member 32 and the second cylinder of the cryocooler 16 is smaller than the diameter of the second cylinder.

In another embodiment, in order to avoid the contact between the cap member 32 and the top cryopanel 52, the cap member 32 having a short axial length is used. The axial length of the cap member 32 is longer than the axial distance from the cap upper end 32*a* to the tip stage surface 24*a*. The axial distance from the cap upper end 32*a* to the tip stage surface 24*a* may be less than 1/10 of the shield depth 41. In addition, the axial length of the cap member 32 is shorter than the axial distance from the inlet cryopanel 31 to the top cryopanel 52.

The cryopanel attachment member 51 is attached to the side surface of the second cooling stage 24 such that the tip stage surface 24*a* directly faces the cap member 32.

The inlet cryopanel 31 includes a plate member. The plate member is one flat plate (for example, circular plate) which crosses the shield main opening 34 and is attached to the shield front end 36 via the joint block 46. The cap upper end 32*a* is attached to the center portion of the lower surface of the plate member. Small holes 31*c* are arranged in the plate member so as to surround the cap upper end 32*a*. The small holes 31*c* penetrate the plate member and gas can flow from the outside of the cryopump 10 to the inside thereof through the small holes 31*c*.

In this way, the cap member 32 can be applied to any vertical type cryopump.

In another embodiment, since the tip stage surface 24*a* can be disposed to be in proximity to the inlet cryopanel 31, it is possible to shorten the entire length in the axial direction of the cryopump 10. It is possible to provide a vertical type cryopump in which the axial length is shortened.

Hereinbefore, embodiments of the present invention are described. It should be understood that the invention is not limited to the above-described embodiment, but may be modified into various forms on the basis of the spirit of the invention. Additionally, the modifications are included in the scope of the invention.

What is claimed is:

1. A cryopump comprising:

a cryocooler which includes a high-temperature cooling stage, a low-temperature cooling stage having an axial tip stage surface, and a cryocooler structure portion which extends in an axial direction from the high-temperature cooling stage to the low-temperature cooling stage;

a radiation shield which is thermally coupled to the high-temperature cooling stage and includes a shield front end which defines a shield main opening and a shield bottom portion having a cryocooler insertion hole which receives the cryocooler structure portion such that the axial tip stage surface faces the shield main opening;

a non-contact cap member which surrounds the axial tip stage surface in a non-contact manner and is thermally coupled to the high-temperature cooling stage; and a low-temperature cryopanel portion which is disposed between the non-contact cap member and the high-temperature cooling stage in the axial direction and is thermally coupled to the low-temperature cooling stage;

wherein the low-temperature cryopanel portion includes a top cryopanel extending in a radial direction perpendicular to the axial direction, the top cryopanel extending radially outward beyond the non-contact cap member;

an inlet cryopanel which is disposed in the shield main opening and is thermally coupled to the high-temperature cooling stage, wherein the non-contact cap member is attached to the inlet cryopanel.

2. The cryopump according to claim 1, wherein the top cryopanel is disposed to be in proximity to the non-contact cap member in the axial direction.

3. The cryopump according to claim 1, wherein the axial tip stage surface is positioned at an upper half of a shield depth from the shield front end to the shield bottom portion, and the top cryopanel of the low-temperature cryopanel portion is positioned at the lower half of the shield depth.

4. The cryopump according to claim 1, wherein the non-contact cap member includes a cap upper end which is positioned above the axial tip stage surface in the axial direction and a cap lower end which is positioned below the axial tip stage surface in the axial direction, and a cap axial length from the cap upper end to the cap lower end is longer than an axial distance from the cap upper end to the axial tip stage surface.

5. The cryopump according to claim 4, wherein an axial distance from the cap upper end to the axial tip stage surface is less than 1/10 of a shield depth from the shield front end to the shield bottom portion.

6. The cryopump according to claim 1, wherein an axial distance from the shield front end to the top cryopanel of the low-temperature cryopanel portion is two times or more an axial distance from the shield front end to the axial tip stage surface.

7. The cryopump according to claim 1, further comprising:

a low-temperature cryopanel attachment member which extends from the low-temperature cooling stage to the low-temperature cryopanel portion in a gap between the non-contact cap member and the low-temperature cooling stage, wherein the low-temperature cryopanel attachment member is attached to a side surface of the low-temperature cooling stage such that the axial tip stage surface directly faces the non-contact cap member.

8. The cryopump according to claim 1, wherein the non-contact cap member is not in physical contact with the high-temperature cooling stage.

9. The cryopump according to claim 1, wherein the cryocooler structure portion includes a cylinder which connects the high-temperature cooling stage to the low-temperature cooling stage, and wherein a radial distance between the non-contact cap member and the cylinder is smaller than a diameter of the cylinder.

10. The cryopump according to claim 1, wherein the non-contact cap member includes a cap upper end which is positioned above the axial tip stage surface in the axial direction and a cap lower end which is positioned below the axial tip stage surface in the axial direction, and a cap axial length from the cap upper end to the cap lower end is shorter than an axial distance from the inlet cryopanel to the top cryopanel of the low-temperature cryopanel portion.

11. The cryopump according to claim 1, wherein an annular empty space having an axial height is formed between the non-contact cap member and the radiation shield in the radial direction.

12. The cryopump according to claim 11, wherein the top cryopanel of the low-temperature cryopanel portion extends radially outward beyond the non-contact cap member so as to define in part a bottom end of the axial height of the annular empty space.

13. The cryopump according to claim 1, wherein a radial distance between the non-contact cap member and the radiation shield is larger than a radial gap between the top cryopanel and the radiation shield.

14. The cryopump according to claim 1, wherein the top cryopanel of the low-temperature cryopanel portion is viewable from the shield main opening.

15. The cryopump according to claim 1, wherein the non-contact cap member is hung from the inlet cryopanel and extends axially downward from the inlet cryopanel.

* * * * *